United States Patent [19]

Lunde

[11] 4,108,339

[45] Aug. 22, 1978

[54] INTEGRAL NOZZLE WITH GAS DELIVERY MANIFOLD

[75] Inventor: Marvin C. Lunde, St. Joseph, Mich.

[73] Assignee: Leco Corporation, St. Joseph, Mich.

[21] Appl. No.: 750,177

[22] Filed: Dec. 13, 1976

[51] Int. Cl.[2] ..... B22D 41/08

[52] U.S. Cl. ..... 222/591; 164/437; 222/603

[58] Field of Search ..... 164/337, 281, 437; 222/590, 591, 603; 106/40 V; 266/220

[56] References Cited

U.S. PATENT DOCUMENTS

| | | | |
|---|---|---|---|
| 3,253,307 | 3/1966 | Giriffiths et al. | 222/591 X |
| 3,351,688 | 11/1967 | Kingery et al. | 264/63 |
| 3,797,712 | 3/1974 | Kutzer et al. | 222/591 |
| 3,838,798 | 10/1974 | Voss | 222/591 X |
| 4,011,291 | 3/1977 | Curry | 264/43 |

FOREIGN PATENT DOCUMENTS

| | | | |
|---|---|---|---|
| 834,234 | 5/1960 | United Kingdom | 222/603 |
| 1,379,236 | 1/1975 | United Kingdom | 222/590 |
| 458,382 | 3/1975 | U.S.S.R. | 222/603 |

OTHER PUBLICATIONS

"A New Process for Continuously Casting Aluminum Killed Steel" Meadowcroft et al., Journal of Metals: Jun. 1971: pp. 11-17.

*Primary Examiner*—Robert B. Reeves
*Assistant Examiner*—David A. Scherbel
*Attorney, Agent, or Firm*—Price, Heneveld, Huizenga & Cooper

[57] ABSTRACT

The specification discloses a ceramic nozzle of the submersible type which includes a permeable bore section surrounded by an annular manifold positioned between the bore section and the less permeable integral body of the nozzle. The manifold is employed for supplying inert gas into the nozzle bore. The nozzle is made by positioning an unfired ceramic bore section on a mandrel inserted into a mold cavity defining the body of the nozzle with the outer surface of the bore section covered with a burnout material which, during the molding of the nozzle, fills the manifold area and after kiln firing burns away to leave a void defining the manifold. The ceramic mix for the bore section includes burnout material, such that after firing the bore section is significantly more permeable than the body of the nozzle.

9 Claims, 3 Drawing Figures

INTEGRAL NOZZLE WITH GAS DELIVERY MANIFOLD

BACKGROUND OF THE DISCLOSURE

In the pouring of molten steel during a continuous casting process from a ladle into a tundish and subsequently from a tundish into the mold, particularly where the molten steel is aluminum killed; it is important to prevent alumina deposits from building up in the bore of the nozzle employed since excessive buildup can clog the nozzle and shut down an entire casting operation. Additionally in some applications, submersible nozzles also referred to as pouring tubes or shrouds are employed to continuously surround the stream of molten metal leaving the ladle or tundish for preventing contamination of the stream or partial oxidation due to exposure to the atmosphere. Again, it is desirable to prevent them from clogging or from erosion by direct contract with the molten metal stream.

Efforts have been made to prevent the buildup of alumina in nozzles by providing means for the injection of an inert gas such as argon into the bore. U.S. Pat. No. 3,838,798 issued to Wendell G. Vos on Oct. 1, 1974, and assigned to the present assignee represents one such effort in which the nozzle includes a ceramic annulus surrounding the bore and into which an inert gas is supplied. U.S. Pat. No. 3,253,307 issued to D. K. Griffiths et al on May 31, 1966, suggests a multiple piece, physically joined nozzle to define a means for regulating a stream of molten metal poured therethrough by the injecting of the inert gas into the nozzle bore. Two-piece nozzles have been made and joined by cementing after each piece is separately fired. In such nozzles the pieces define a bore portion and a body portion with a space therebetween for providing a manifold surrounding the bore and into which a pressurized inert gas can be supplied for injection into the bore of the nozzle.

Although these approaches represented by the prior art have significantly reduced the deposit of alumina in nozzles and permitted more efficient continuous casting, their success has been limited due in part to the manner in which they are manufactured, either making them failure prone or very difficult to make. Nozzles with cemented junctions frequently crack in use due to the different temperature expansion characteristics of the materials and the cement. Such nozzles thus are relatively expensive to manufacture and have not met with success.

SUMMARY OF THE INVENTION

The nozzle of the present invention overcomes the difficulties of the prior art by providing a nozzle having a bore portion of a significantly permeable ceramic material and an integral body portion of less permeable ceramic material with a manifold between the two portions for supplying pressurized inert gas to the nozzle bore through the permeable portion.

This integral nozzle construction is made possible by the process including the steps of molding the permeable bore section and in its green state surrounding it with a burnout material and positioning it within a mold cavity for further molding to define the body portion. Once the composite molded green piece is fired, the resultant integral ceramic nozzle includes a void defining the manifold and provides improved structural strength and gas distribution characteristics.

The resultant product, free of cemented junctions, is less prone to failure due to the thermal shock incurred when the molten material passes through the nozzle, is less expensive to manufacture; and provides improved performance. These and other advantages and objects of the present invention can best be ascertained by reading the following descriptions thereof, together with the accompanying drawings in which:

DETAILED DESCRIPTION OF THE PREFERRED EMBODIMENT

Figure 1:
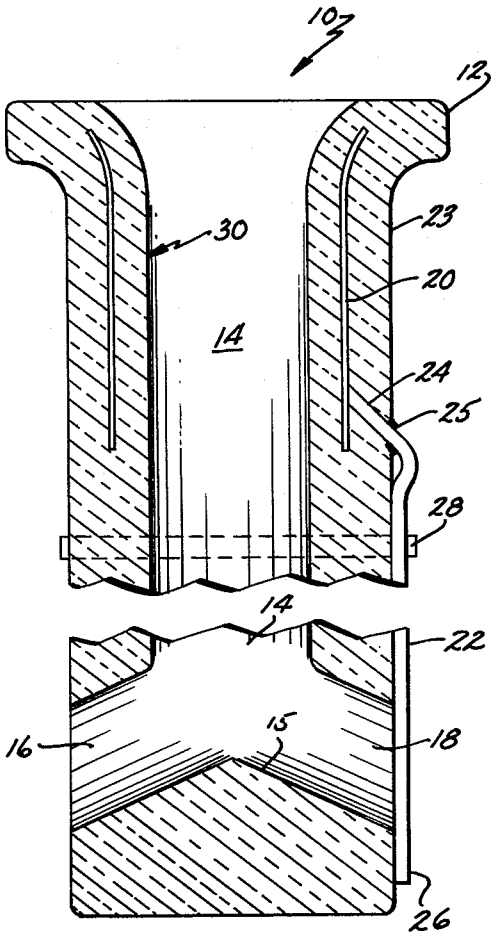
FIG. 1 is a cross-sectional view, partly broken away, of a nozzle embodying the present invention.

Referring initially to FIG. 1, there is shown a nozzle 10 embodying the present invention and which in the preferred embodiment constitutes a submergible nozzle, also, commonly referred to as a shroud or pouring tube. The ceramic nozzle typically is mounted to the bottom of a ladle or of a tundish for pouring molten steel in a continuous casting operation, particularly when employing aluminum killed steel. For this purpose, a circular mounting flange 12 is integrally formed near the top of the nozzle. For pouring the molten metal, the nozzle includes a longitudinally extending central bore 14 extending through the top surface of flange 12, where it is enlarged somewhat, and terminating at an end portion 15 of the nozzle. A pair of downwardly and radially outwardly extending spouts 16 and 18 extend from the bore through the side of the nozzle. In some instances the bore 14 will extend longitudinally through the entire length of the nozzle instead of providing radially extending exit spouts as in the preferred embodiment.

The ceramic material forming the upper portion 30 of the bore is a relatively permeable ceramic material once fired, and thus includes a plurality of pores or tiny passageways extending radially through its wall. A circumferentially extending annular void defining a manifold 20 surrounds this bore portion and extends longitudinally along the nozzle 10 downwardly from an area near the top of the nozzle. The outer side of manifold 20 is enclosed by the body portion 23 of the nozzle which is made of a significantly less permeable ceramic material. In order to supply an inert gas to manifold 20 and consequently to bore 14, a gas supply tube 22 is provided and is cemented within an aperture 24 extending radially inwardly through the wall of body 23 and communicating with manifold 20. End 26 of tube 22 can be coupled to a source of pressurized inert gas such as argon which will pressurize manifold 20 permitting the inert gas to be supplied to nozzle bore 14. Supply tube 22 is secured to the side of the nozzle by means of a steel band 28, permitting the end 26 to be bent away from the nozzle for attachment to the source of inert gas without breaking the sealed connection of the tube to the nozzle. The opposite end of the tube is sealably secured to the body of nozzle 10 within aperture 24 by means of a suitable ceramic cement 25.

The resultant nozzle 10, defining in the preferred embodiment a shroud, is an integral one-piece ceramic member constituting a body and a bore portion with an elongated annular shaped void defining a manifold circumferentially surrounding and spaced from the bore 14 by means of a relatively permeable ceramic portion. The unique manner in which this nozzle is constructed is now explained with reference to FIGS. 2 and 3.

Figure 3:
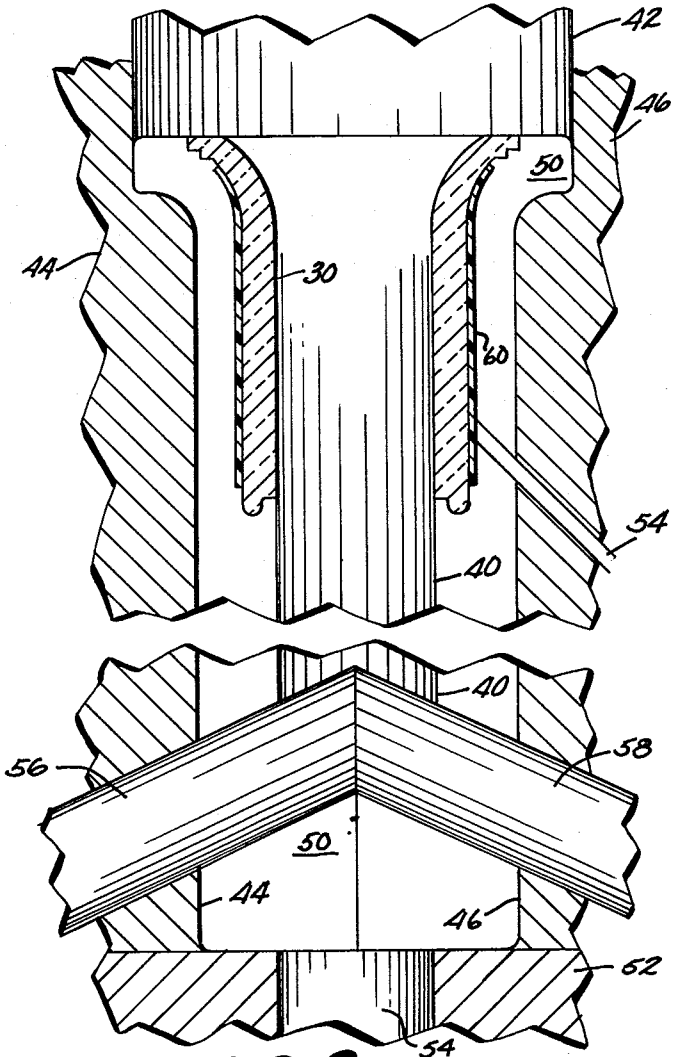
FIG. 3 is a cross-sectional view, partly broken away, of the manufacturing process for the manufacture of a nozzle embodying the present invention.
Figure 2:
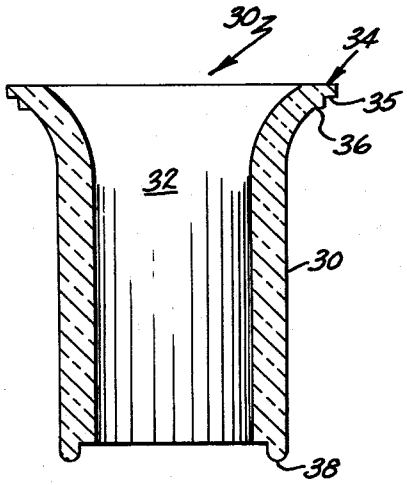
FIG. 2 is a cross-sectional view of the permeable bore section of the nozzle embodying the present invention.

In order to provide the single piece ceramic nozzle having a bore portion with a significantly more permeable property than the body of the shroud and thereby permitting the application of inert gas directly to the bore of the nozzle while maintaining the mechanical strength of the nozzle; the permeable bore portion 30 shown in FIG. 2 is first injection molded. The green (i.e. unfired) ceramic piece is placed on a mandrel 40 extending downwardly into a mold cavity 50 (FIG. 3) such that the remaining body portion of the shroud can be molded around and into the bore portion 30 to provide a composite green piece which, when fired, fuses into an integral nozzle. In order to provide the void or manifold 20, a layer of burnout material 60 is applied to the outer surface of bore portion 30 as shown in FIG. 3 to occupy the space during molding which ultimately defines the void when the article is fired and the burnout material vaporizes. Having briefly described the overall process, a detailed description of the formation, first of the bore portion 30 and subsequently the injection and firing of the entire nozzle, is now presented.

The bore section 30 comprises a generally cylindrical ceramic member having a flared upper end 34 which occupies the bore portion of the flange 12 of the nozzle 10 when completed and which includes a longitudinally extending bore 32 which forms the upper portion of bore 14 of the nozzle. In the preferred embodiment, the bore portion 30 had a wall thickness of $\frac{3}{8}$ of an inch and extended longitudinally about 6 inches. At the top or flange end 34 a pair of step cuts 35 and 36 are formed constituting alternate vertical and horizontal segments extending circumferentially around the flange portion 34 to increase the mating surface area with the remaining body of the nozzle when injection molded by the system shown in FIG. 3. At the lower end of the bore section 30 there is provided an elongated and rounded extension 38 which serves a similar purpose. The nozzle 10 of the preferred embodiment basically constitutes a fused silica shroud and manufactured of a base material mixed with a binder permitting its injection molding and which is removed during the firing process. The permeable bore section 30 further includes a burnout material which, when kiln fired, provides the desired permeability. The amount of permeability is controlled by how much burnout material is added to the mix. In the preferred embodiment, the mixture for the bore section 30 comprises the following:

TABLE I

| | | Parts by Weight |
|---|---|---|
| A. | Ceramic | |
| | 1. Fused Silica 50/100 | 56 |
| | 2. Fused Silica −325 | 44 |
| B. | Binder | |
| | 1. Wax - Paraffin | 11.8 |
| | 2. Oleic Acid | .9 |
| | 3. Alrosperse | .2 |
| C. | Burn-out Material to make Permeability | |
| | 1. Plastic Microballons | .70 |
| | 2. Wood Flour | .88 |

These materials are mixed in a heated vat to form a uniform and injectable mixture as described in greater detail in the batching and mixing processes disclosed in copending U.S. patent application Ser. No. 609,493 filed on Sept. 2, 1975, entitled APPARATUS AND METHOD OF MANUFACTURE OF ARTICLES CONTAINING CONTROLLED AMOUNTS OF BINDER, now U.S. Pat. No. 4,011,291, assigned to the present assignee and the disclosure of which is incorporated herein by reference. Once the injection mixture is completed, the bore portion 30 is injection molded into the generally cylindrical shape shown in FIG. 2. It is removed from the injection mold as a green piece and utilized as such (i.e. before firing) in the apparatus shown in FIG. 3 to form the composite nozzle in a green state prior to firing. Before the bore portion 30 is positioned on mandrel 40 shown in FIG. 3, the burnout material employed to define the void 20 (FIG. 1) is wrapped around the outer surface 33 of the member 30. In the preferred embodiment, the material 60 comprises an expanded polymeric wrapping material frequently used for packaging of parts and was $\frac{1}{4}$-inch thick after being wrapped tightly around the outer surface of member 30. This material has a length of approximately 6 inches and a width sufficient to encompass the outer surface of member 30. In the preferred embodiment commercially available plastic wrap known as F-250 foam wrap and sold by the Schwarz Paper Company, LaPorte, Indiana, was employed. Other expanded polymeric materials or organic combustible materials which incinerate at the ceramic firing temperatures of 2100° F. to 2200° F. without leaving significant ashes could also be used. In order to hold the sheet of material to member 30 during the injection molding of the remaining body portion of the shroud, a spray-on adhesive was used. Other adhesives could also be used so long as they are generally organic and will be vaporized during the firing of the composite ceramic article. Material 60 is fitted just below the step 36 such that it follows the outwardly curved wall portion of member 30 as seen in FIG. 3.

The bore portion 30 together with the surrounding burnout material 60 is then fitted onto the mandrel 40. In its green state the member 30 has sufficient binder to secure the piece in position on the upper portion of the vertically extending mandrel 40 as seen in FIG. 3. Mandrel 40 is internally heated and extends from an elevatable and lowerable platform 42 into the mold halves 44 and 46 defining the cylindrical nozzle mold cavity 50.

The mold cavity 50 terminates at its lower end at a base plate 52 having a cylindrical injection gate 54 extending upwardly therethrough and communicating with the interior of the mold (i.e. the mold cavity 50). In order to define the aperture 24 as well as the exit spouts 16 and 18 of the nozzle, core pins 54, 56 and 58 are removably inserted into the mold cavity and are in the position shown in FIG. 3 during the injection of the mold body around member 30. Once the injection has been completed, these core pins and mandrel are removed from the mold; the mold halves 42 and 46 are separated such that the composite articles can be removed from the molding apparatus. A more detailed description of the preferred molding apparatus and its sequence of operation is disclosed in copending U.S. patent application Ser. No. 646,235 filed on Jan. 2, 1976, for CERAMIC ARTICLE AND A METHOD AND APPARATUS FOR FORMING SAME, now abandoned, which application is assigned to the present assignee and the disclosure of which is incorporated herein by reference.

The ceramic body portion exclusive of the permeable bore portion 30 also consists of a combination of fused silica and a binder material. It does not use, however, a burnout material to increase the permeability as does the member 30. Thus after firing the outer body portion of the nozzle surrounding manifold 20 is essentially impervious to the flow of gas therethrough which, consequently, is forced through bore section 30 into the nozzle bore 14. In the preferred embodiment, the following mixture has been successfully employed for the nozzle body:

TABLE II

| | | Parts by Weight |
|---|---|---|
| A. | Ceramic | |
| | 1. Fused Silica 10/20 mesh | 27 |
| | 2. Fused Silica −14 mesh | 28 |
| | 3. Fused Silica −325 mesh | 45 |
| B. | Binder | |
| | 1. Wax - Paraffin | 6.34 |
| | 2. Alrosperse | .20 |
| | 3. Oleic Acid | .25 |

The composite green piece constituting the inner bore section 30, the surrounding ceramic body 23 and the still intact burnout annular insert 60 is then dewaxed to remove the binder and subequently fired according to the dewaxing and firing process described in the first above identified patent application and also described in greater detail in copending U.S. patent application Ser. No. 626,741 filed on Oct. 29, 1975, entitled METHOD OF MANUFACTURING CERAMIC ARTICLES, now abandoned, which application is assigned to the present assignee and the disclosure of which is incorporated herein by reference. During firing the burnout material 60 is completely vaporized leaving in its place a void defining manifold 20 as shown in FIG. 1. Subsequent to the firing operation, the stainless steel tube 22 is inserted in the aperture 24 and which extends at an angle of approximately 45° into the manifold area 20 and is cemented in place at 25 as shown in FIG. 1.

In the nozzle or shroud 10 of the preferred embodiment the bore 14 had a diameter of approximately 2.75 inches while the flange 12 had an outer diameter of 7.5 inches and thickness (depth) of 1 inch. The overall nozzle length is 25 inches while the manifold 20 was approximately 6 inches long and extended from a position 0.5 inches from the top of flange 12 downwardly and concentrically with bore 14. During firing the permeable member 30 and the remaining ceramic body become fused to form the integral, single-piece member with the burnout material escaping primarily through the permeable material 30 during firing. The overall outer diameter of the shroud was approximately 5.5 inches, and the exit ports 16 and 18 had a diameter of 2 inches. The quarter-inch tube 22 was made of stainless steel as was band 28 employed for securing the tube adjacent to the body of the shroud.

The concentric manifold positioned in the upper portion of the nozzle and extending longitudinally about one-fourth to one-third of the length provides the desired distribution of inert gas in the nozzle bore in use. The permeability of the bore section 30 should be controlled to provide sufficient gas flow in the bore while the remaining body of the nozzle is essentially impervious to gas flow. In the preferred embodiment the permeability of member 30 permitted a gas flow of 0.120 $ml/min/cm^2/cm/H_2O$. The useful range of permeability will, however, include 0.004 to 0.400 $ml/min/cm^2/cm/(H_2O)$. In terms of porosity (a measure of the density of the material) section 30 of the preferred embodiment has a porosity of about 20% while the body 23 has a porosity of about 12%.

It will become apparent to those skilled in the art that the concept of the present invention can be applied to a variety of shrouds, nozzles and other pouring devices used in the steel industry and the specific shape of the body and permeable bore member can be significantly varied. Also, the material employed may encompass, for example, zirconium, zirconia or other ceramic materials as desired. These and other modifications to the preferred embodiment disclosed and described herein, however, will fall within the spirit and scope of the present invention as defined by the appended claims.

The embodiments of the invention in which and exclusive property or privilege is claimed are defined as follows:

1. An integral ceramic nozzle comprising:

a bore section having a cylindrical wall with an outwardly extending flange at one end and an axially extending cylindrical bore formed therethrough, said bore wall including means for the passage of gas therethrough into said cylindrical bore;

a non gas-permeable ceramic body surrounding said bore section and including a flange at one end surrounding said flange of said bore section and an open opposite end and including a bore extending between said cylindrical bore of said bore section and said open opposite end, said body and bore section defining therebetween a relatively thin elongated hollow annular manifold extending from said flange of said bore section substantially the length of said bore section; and means for supplying an inert gas to said manifold.

2. The apparatus as defined in claim 1 wherein said bore section terminates in said body, and said body includes a pair of exit apertures extending radially outwardly from said bore through said nozzle.

3. The apparatus as defined in claim 1 wherein said nozzle is made of fused silica.

4. The apparatus as defined in claim 1 wherein said nozzle is elongated to define a shroud.

5. The apparatus as defined in claim 4 wherein said means for the passage of gas through said bore section comprises said bore section made of a gas-permeable material and wherein said bore section is proximate said flange of said shroud.

6. The apparatus as defined in claim 1 wherein said supplying means includes an aperture formed through said body and communicating with said manifold and conduit means sealably coupled to said aperture.

7. The nozzle as defined in claim 1 wherein said flange of said bore section includes alternately formed surfaces defining a step to increase the surface contact area between said flange of said bore section and said flange of said body.

8. An integral ceramic nozzle comprising:

a generally cylindrical gas-permeable bore section having a flange at one end and an axially extending cylindrical bore formed therethrough;

a non gas-permeable ceramic body surrounding said bore section and including a flange at one end surrounding said flange of said bore section and an open opposite end and including a bore extending between said cylindrical bore of said bore section and said open opposite end, said body and bore section defining therebetween a relatively thin elongated hollow annular manifold, said manifold extending from said flange substantially the length of said bore section; and means for supplying an inert gas to said manifold.

9. The nozzle as defined in claim 8 wherein said flange of said bore section includes alternately formed surfaces defining a step to increase the surface contact area between said flange of said bore section and said flange of said body.

* * * * *

UNITED STATES PATENT AND TRADEMARK OFFICE

CERTIFICATE OF CORRECTION

PATENT NO. : 4,108,339

DATED : August 22, 1978

INVENTOR(S) : Marvin C. Lunde

It is certified that error appears in the above-identified patent and that said Letters Patent are hereby corrected as shown below:

Column 1; line 20:
"contract" should be --contact--

Column 4; line 62:
"for" should be --entitled--

Column 5; line 21:
"subequently" should be --subsequently--

Column 6; line 9:
"and" should be --an--

Signed and Sealed this

*First* Day of *May 1979*

[SEAL]

*Attest:*

RUTH C. MASON
*Attesting Officer*

DONALD W. BANNER
*Commissioner of Patents and Trademarks*